US005953197A

United States Patent [19]

Driendl

[11] Patent Number: 5,953,197

[45] Date of Patent: Sep. 14, 1999

[54] METHOD FOR OPERATING A REPLAY ARRANGEMENT TO REDUCE NOISE DUE TO ACCELERATION

[75] Inventor: Hans Dieter Driendl, Deggenhausertal, Germany

[73] Assignee: Temic Telefunken microelectronic GmbH, Heilbronn, Germany

[21] Appl. No.: 09/044,851

[22] Filed: Mar. 20, 1998

[30] Foreign Application Priority Data

Mar. 26, 1997 [DE] Germany ..... 197 12 721

[51] Int. Cl.[6] ..... H01H 47/00

[52] U.S. Cl. ..... 361/191; 361/189

[58] Field of Search ..... 361/154, 160, 361/152, 166, 189, 191, 210, 187, 194, 1–13; 335/78, 80, 106, 128; 307/137, 142

[56] References Cited

U.S. PATENT DOCUMENTS

| | | | |
|---|---|---|---|
| 4,893,102 | 1/1990 | Bauer | 335/132 |
| 4,922,363 | 5/1990 | Long et al. | 361/3 |
| 5,202,813 | 4/1993 | Uota et al. | 361/154 |
| 5,224,014 | 6/1993 | Fowler et al. | 361/185 |
| 5,267,120 | 11/1993 | Graff et al. | 361/185 |
| 5,539,608 | 7/1996 | Hurley et al. | 361/152 |
| 5,687,050 | 11/1997 | Bartsch | 361/154 |
| 5,774,323 | 7/1998 | Innes et al. | 361/187 |

FOREIGN PATENT DOCUMENTS

| | | |
|---|---|---|
| 1124153 | 2/1962 | Germany . |
| 4122704C2 | 1/1993 | Germany . |

*Primary Examiner*—Jeffrey Gaffin
*Assistant Examiner*—Kim Huynh
*Attorney, Agent, or Firm*—Venable; George H. Spencer; Catherine M. Voorhees

[57] ABSTRACT

A method is described for operating a relay arrangement having a magnetic circuit comprising two excitation core each arranged on a core, a yoke and an unstably mounted armature, two contact springs that can be operated by the unstably mounted armature, two make contacts, two changeover contacts and a common break contact. In the normal state of the relay arrangement, the two changeover contacts are connected to the common break contact and when the response threshold of the relay arrangement is reached one of the two changeover contacts is connected to the corresponding make contact. The magnetic circuit is excited electromagnetically in the normal state of the relay arrangement in order to generate a normal-state armature force that acts on the unstably mounted armature. The electromagnetic excitation is generated by means of a normal-state excitation current through one of the two excitation coils the current intensity of which is selected such that the normal-state armature force is lower than that which occurs at the response threshold of the relay arrangement.

9 Claims, 1 Drawing Sheet

METHOD FOR OPERATING A REPLAY ARRANGEMENT TO REDUCE NOISE DUE TO ACCELERATION

BACKGROUND OF THE INVENTION

Relays are used in a variety of electrical engineering applications in order to effect switching operations, in particular to drive loads such as motors, lamps, valves etc. conventional relays consist of a magnetic circuit with a magnetic coil (excitation coil) wound onto a core made of magnetically conductive material, with a magnetic yoke, and with an armature held by means of a spring (for example, a metal spring) and a set of contacts with contacts (for example a make contact, a changeover contact and a break contact) and with contact elements The switching characteristics of the relay, i.e. the present switched state (in particular the normal state assumed when there is no excitation and the operate state assumed on reaching the response threshold) is controlled by driving the excitation coil and the effect of this on the set of contacts. Depending on the intensity of the excitation current through the excitation coil, a magnetic field Is produced in the magnetic circuit that causes the contacts in the set of contacts to move as a result of which a specific output signal (an alternating function) is to be generated at the output of the relay (for example to drive the load connected to that output. For example, in the above-mentioned set of contacts that make contact, changeover contact and break contact, the changeover contact is connected to the break contact In the normal state (no current flow in the excitation coil); the changeover contact moves away from the break contact when (excitation) current flows through the excitation coil (this causes a specific force to be applied to the armature) and when a specific intensity of excitation current is reached (at the response threshold of the relay) the changeover contact is drawn onto the make contact.

In order to provide polarity reversal functions, in which the output signal is to exhibit a change in polarity (which is required in many applications, e.g. motor polarity reversal), relay arrangements can be used comprising two interconnected relays with changeover function. To simplify the design of such relay arrangements, components of the magnetic circuit and/or the set of contacts (contacts and/or contact elements) of both relays can be assigned jointly: Usually, a magnetic circuit Is provided comprising two excitation coils that can be driven independently of each other, a common yoke and an unstably mounted armature between the two excitation coils. Furthermore, in the above-mentioned set of contacts, a common break contact can be provided (in addition to the two changeover contacts and the two make contacts). By means of the unstably mounted armature, the contact elements of the set of contacts are operated thus effecting the desired switching behavior at the output of the relay arrangement (output signal polarity change). For example, the make contacts can be "closed" (connected to the changeover contact) by means of two contact springs each connected to a changeover contact. It is advantageous In this relay arrangement with unstably mounted armature that the space requirement, production complexity and therefore the production costs are minimized. It is however disadvantageous that when the unstably mounted armature is in the normal state (i.e., no current flow in the two excitation coils, the armature is pulled away from the two excitation coils by spring force), external acceleration factors cause rattling noises which, in many applications, have a disturbing effect (for example, in the passenger compartment of a motor vehicle: electrically operating window lifters, seat adjusters, sunroof etc.).

The object of the invention is to specify a method that allows the noise emitted by the relay arrangement in the normal state to be reduced in a simple way.

SUMMARY OF THE INVENTION

This object is solved in accordance with the invention by the following steps: electromagnetically exciting a magnetic circuit in the normal state of the relay arrangement in order to generate a normal-state armature force on an unstably mounted armature of the magnetic circuit; producing electromagnetic excitation in the magnetic circuit by causing normal-state excitation current to flow through one of the two excitation coils of the magnetic circuit; and selecting the intensity of the normal-state excitation current so that the normal-state armature force is smaller than the armature force which occurs at the response threshold of the relay arrangement.

Advantageous further developments and embodiments of the invention will become apparent from the following description.

In the method presented here, a play-free preferred position is impressed without mechanical means on the unstably mounted armature of the relay arrangement in the normal state In order to reduce noise. This play-free preferred position in the normal state of the relay arrangement is forced in that a defined minute electromagnetic excitation of the magnetic circuit is generated by allowing a specific minute (normal state) excitation current to flow through one of the two excitation coils which results in a minute force being exerted on the armature and hence on at least one contact element (e.g. on a contact spring) (in other words, a minute normal-state armature force, e.g. a minute spring force, is generated).

The electromagnetic excitation of the magnetic circuit (and consequently the normal-state excitation current through one of the two excitation coils) In the normal state of the relay arrangement is selected such that the resultant normal-state armature force acting on at least one contact element of the set of contacts (e.g. on a contact spring) on the one hand reliably prevents noise being developed by external acceleration factors (i.e. through mechanical excitation), yet on the other hand reduces the contact force acting between the contacts of the set of contacts (e.g. between the break contact and the changeover contact) only to a small degree, i.e. the normal-state excitation current is selected such that the normal-state armature force Is on the one hand big enough to reliably prevent rattling noises occurring at the armature in the presence of external acceleration factors (where there is mechanical excitation), yet on the other hand is small enough for the normal-state armature force to have no negative effect on the contact force (which ensures that current passes reliably between the contacts of the set of contacts—e.g. between the changeover contacts and the make contacts and the common break contact—and also that the normal state of the relay arrangement is unambiguously correlated to the normal position of the armature.

With the low current intensity (Which is below the response threshold of the relay arrangement because no significant deflection of one of the contact elements, e.g. a contact spring, occurs) selected for the normal-state excitation current In order to ensure a defined preferred position of the armature in the normal state of the relay arrangement, with almost constant air gap conditions and without saturation phenomena in the magnetic circuit (this can be assumed on account of the low flux density), the armature force, and hence the normal-state armature force also, is approximately a linear function of the excitation current, i.e. if the electromagnetic parameters of the relay arrangement and the current intensity of the normal-state excitation current are known then the normal-state armature force can be determined by simple means.

The electromagnetic excitation of the magnetic circuit in the normal state of the relay arrangement can be generated either by (time-) continuous or by discontinuous (in particular pulsed) driving of the relay arrangement: In the case of continuous driving of the relay arrangement, the amplitude of the relay arrangement operating voltage used to generate the normal-state excitation current is varied, In particular the amplitude of the operating voltage is reduced significantly (eg. from 12 V to 1 V) compared with normal operation. When the relay arrangement is driven In the pulsed mode, the amplitude of the operating voltage of the relay arrangement is retained but the operating voltage varies with respect to time and In particular the time over which the applied operating voltage acts compared with normal operation (the "normal" alternating operation) is reduced significantly.

With pulsed driving of the relay arrangement, the time over which the applied operating voltage acts can be controlled, for example, by means of pulse width modulation with preset pulse duty factor (or preset ratio of pulse to no-pulse times) where the current Intensity of the normal-state excitation current, i.e. the level of the electromagnetic excitation and thus the value of the normal-state armature force, can be set by means of the pulse duty factor. The pulse duty factor can be produced by a control unit (e.g. of the microcontroller type). Usually, a control unit is already available. The pulse-shaped normal-state excitation current can generally be allowed to flow through the excitatlon coil by means of a driver stage which is also usually available. As a rule, therefore, no additional components are needed to drive the relay arrangement in the normal state and consequently no additional costs are involved The repetition rate (pulse frequency) when applying the pulsed driving method must be selected to be considerably higher than the resonant frequency of the mechanical resonance circuit formed by the inertial mass of the unstably mounted armature and the contact elements (e.g. the spring constant of the two contact springs) in order to keep as low as possible the force modulation of the contact forces (e.g. the pressing force of the changeover contacts on the common break contact) that arises as a result of the pulsed driving mode because the contact forces required for reliable switching of the relay arrangement should be approximately constant.

In an advantageous further development of the method, the electromagnetic excitation of the magnetic circuit in the normal state Is adjusted adaptively to the secondary conditions (e.g. manufacturing tolerances of the components, aging effects, operating voltage) and/or the environmental conditions (e.g. the external acceleration acting on the relay arrangement, the mass of the armature, the contact force between the contacts) because the electromagnetic excitation can fluctuate in accordance with these parameters that have an effect on the relationship between excitation current and armature force. In this adaptive method, the actual value of the response threshold of the relay arrangement is established in a "learning procedure" by increasing the electromagnetic excitation (and thus the excitation current) continuously or in steps. This actual value for the response threshold of the relay arrangement can be established either directly by electrical monitoring of the contacts of the set of contacts of the relay arrangement or indirectly by monitoring the load driven at the output of the relay arrangement The value for the electromagnetic excitation in the normal state is interpolated on the basis of this actual value of the response threshold established from the actual secondary conditions as reference value. This interpolation can be on the basis of a linear or a non-linear behavior. This "learning procedure" is performed once, several times or cyclically depending on the application and the anticipated environmental/secondary conditions as well as their variations with respect to time. The value of the adaptively determined electromagnetic excitation in the normal state thus makes allowance for the actual environmental conditions and secondary conditions and therefore the reliability of the method is enhanced.

DESCRIPTION OF A PREFERRED EMBODIMENT

The method according to the invention will now be described with reference to a preferred embodiment for a relay arrangement which has a specific set of contacts, namely two make contacts, two changeover contacts and a common break contact as contacts as well as contact springs as contact elements.

Figure 1:
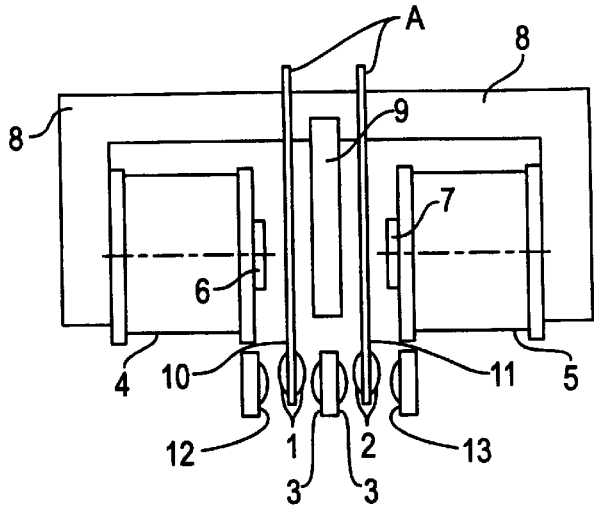
FIG. 1: is a schematic illustration of a relay arrangement with unstably mounted armature.

The relay arrangement with unstably mounted armature is intended to provide the polarity reversal function of a d.c. motor used, for example, to operate the sunroof in a motor vehicle. In accordance with FIG. 1, the relay arrangement consists of two changeover contacts 1, 2, a common break contact 3, two make contacts 12, 13, the two excitation coils 4, 5, with their ferromagnetic core 6, 7 arranged on a ferromagnetic yoke 8, the unstably mounted armature 9 and the two contact springs 10, 11. Two changeover contacts 1, 2 are located on either side of respective contact springs 10, 11. Contacts 1, 2 are operated by means of the common armature 9 and the two contact springs 10, 11, so that as high a contact force as possible (resulting from the spring force of the contact springs 10, 11) is provided between the two changeover contacts 1, 2 and the common break contact 3 in the normal state (no current flow in the excitation coils 4, 5 and thus no electromagnetic excitation of the magnetic circuit formed from excitation coil 4 and 5 respectively, ferromagnetic core 6 and 7 respectively and ferromagnetic yoke 8). The armature 9 must not exert any appreciable counterforce on the two contact springs 10, 11, and therefore the armature 9 is mounted unstably with mechanical play between the contact springs 10, 11.

Figure 2:
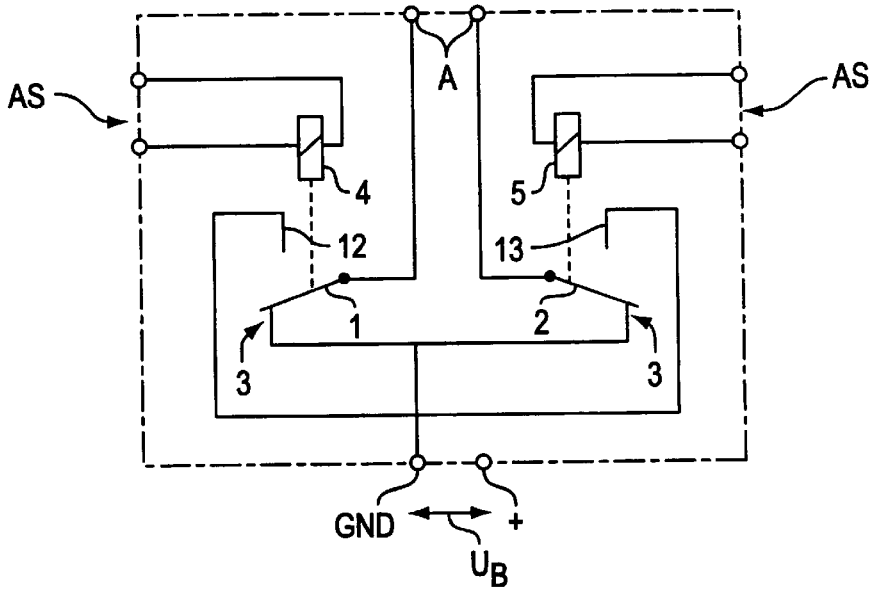
FIG. 2: is a schematic diagram showing an electrical operating principle of a relay arrangement with unstably mounted armature.

In accordance with FIG. 2, one of the two changeover contacts 1 or 2 respectively is drawn from the common break contact 3 to the corresponding make contact 12 or 13 respectively, depending on the current flow in one of the two excitation coils 4 and 5 respectively as a result of a drive signal AS from the electromagnetic excitation of the magnetic circuit. The drive signal AS is; formed from excitation coil 4 and 5 respectively, ferromagnetic core 6 and 7 respectively and ferromagnetic yoke 8, and as a result the desired voltage level is set at output A of the relay arrangement (the inductive load, e.g, the d.c motor, is connected to this output). The operating voltage $U_B$ of the relay arrangement is applied across the common break contact 3 (connected, for example, to the reference potential GND) and the make contact 12 or 13 respectively (connected, for example, to the positive supply voltage+).

Figure 3:
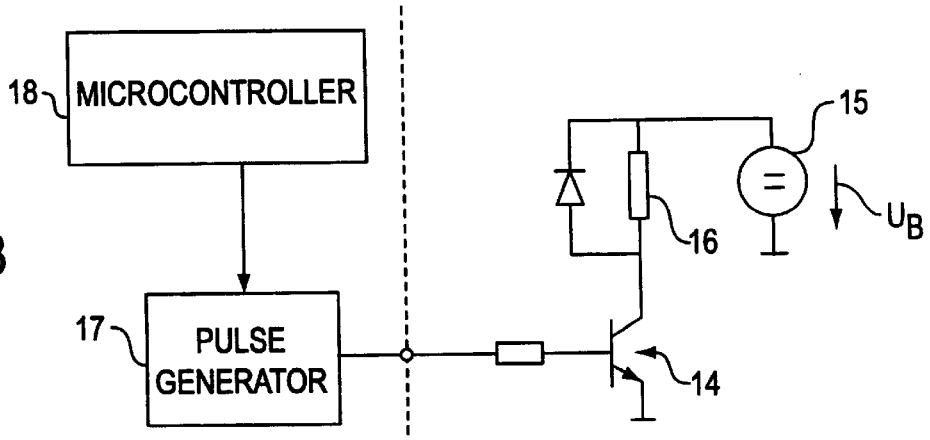
FIG. 3: is a schematic block diagram for a means of driving a relay arrangement with unstably mounted armature.

In accordance with FIG. 3, one of the two excitation coils 4 and 5 respectively is driven in the pulsed mode while the relay arrangement is in the normal state in order to ensure a defined minute electromagnetic excitation (below the response threshold of the relay arrangement) and thus a defined presetting of the active armature force (and hence a defined presetting of the position of the armature). This excitation coil 4 or 5 respectively is supplied with a specific normal-state excitation current from a driver stage In the form of transistor stage 14 which, for example, is of the emitter-base circuit type.

The pulsed-mode control of the transistor stage 14, and hence of the excitation coil 4 and 5 respectively, is performed by means of a pulse generator 17 whose output signal (which can be pulse width modulated) generates a specific pulse duty factor (and hence a specific relationship between on-time and off-time of transistor stage 14). The pulse duty factor is given, for example, by a microcontroller 18 with allowance being made for the influencing factors of actual operating voltage $U_B$ of the operating voltage source 15 and resistance value $R_I$ of the Internal resistance 16 of the energized excitation coil 4 or 5 respectively.

For example, in a relay arrangement with the characteristic values:

Armature mass: $m_A$=1.2 g,

Closing force in the normal state: $F_S$=500 mN,

Armature force slope (in the normal state): $S_A$=10 N/A,

Internal resistance of the excitation coil: $R_I$=110Ω,

Nominal operating voltage: $U_B$=13 V,

Rattling noises from the armature up to an acceleration value a can be suppressed by a normal state armature force (normal excitation) $F_A$ $m_A$* a—for example, at possible acceleration values of $a_{max}$ up to 10 g (98.1 m/s$^2$) an armature force $F_A$=$a_{max}$* $m_A$=118 mN is necessary in the normal state.

If the relay arrangement is driven continuously, the excitation current is:

$$I_R=F_A/S_A=11.8 \text{ mA}.$$

If the relay arrangement is driven in the pulsed mode, the pulse duty factor TV and the percentage ON-time $T_{on}$ is:

$$TV=T_{on}=100\%*I_R*R_I/U_B=10\%.$$

What is claimed is:

1. A method for operating a relay arrangement with a magnetic circuit having two excitation coils, each arranged on a respective core, and an unstably mounted armature located between the two excitation coils; and a set of contacts comprising contacts and contact elements that are operated by the unstably mounted armature, where the relay arrangement assumes different switched states in a normal state and on reaching a response threshold, said method comprising the steps of:

electromagnetically exciting the magnetic circuit in the normal state of the relay arrangement in order to generate a normal-state armature force on the unstably mounted armature of the magnetic circuit and thus on one of the contact elements thereby moving a contact on the contact element;

producing electromagnetic excitation in the magnetic circuit by causing normal-state excitation current to flow through one of the two excitation coils of the magnetic circuit; and selecting the intensity of the normal-state excitation current so that the normal-state armature force is smaller than the armature force which occurs at the response threshold of the relay arrangement.

2. The method in accordance with claim 1, wherein the current intensity of the normal-state excitation current is preset as an application-specific constant.

3. The method in accordance with claim 1, wherein the current intensity of the normal-state excitation current is variably preset and is adjusted adaptively to the environmental and secondary conditions of the relay arrangement.

4. The method in accordance with claim 3, wherein the current intensity of the normal-state excitation current is preset after having completed a learning procedure, and wherein the current intensity of the excitation current at the response threshold of the relay arrangement is taken as an output value for the learning procedure.

5. The method in accordance with claim 1, wherein the electromagnetic excitation of the magnetic circuit is generated by driving one of the two excitation coils with a time-continuous normal-state excitation current.

6. The method in accordance with claim 1, wherein the electromagnetic excitation of the magnetic circuit is generated by driving one of the two excitation coils with a pulse width modulated normal-state excitation current.

7. The method in accordance with claim 6, wherein the pulse duty factor for driving one of the two excitation coils is preset according to at least one of the external acceleration acting on the relay arrangement and one of the mass of the unstably mounted armature and the contact force between the contacts of the set of contacts.

8. The method in accordance with claim 1, wherein the set of contacts comprises two make contacts, two changeover contacts, one common break contact, and two contact springs.

9. The method in accordance with claim 8, wherein one of the two excitation coils is driven according to the contact force between the common break contact and the two changeover contacts.

* * * * *